US007422316B2

(12) United States Patent
Shinada

(10) Patent No.: US 7,422,316 B2
(45) Date of Patent: Sep. 9, 2008

(54) LIQUID CONTAINER AND METHOD FOR DETECTING REMAINING QUANTITY OF LIQUID

(75) Inventor: Satoshi Shinada, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 363 days.

(21) Appl. No.: 11/184,611

(22) Filed: Jul. 19, 2005

(65) Prior Publication Data

US 2006/0017755 A1 Jan. 26, 2006

(30) Foreign Application Priority Data

Jul. 23, 2004 (JP) ..... P2004-215332

(51) Int. Cl.
*B41J 2/175* (2006.01)
*B41J 29/393* (2006.01)

(52) U.S. Cl. ..... 347/86; 347/85; 347/19

(58) Field of Classification Search ..... 347/7, 347/85, 86, 87; 137/264
See application file for complete search history.

(56) References Cited

U.S. PATENT DOCUMENTS

| | | | | |
|---|---|---|---|---|
| 4,432,005 | A * | 2/1984 | Duffield et al. | 347/85 |
| 4,973,993 | A | 11/1990 | Allen | |
| 5,315,317 | A * | 5/1994 | Terasawa et al. | 347/7 |
| 5,666,146 | A * | 9/1997 | Mochizuki et al. | 347/86 |
| 6,267,474 | B1 * | 7/2001 | Mochizuki | 347/86 |
| 6,471,343 | B1 * | 10/2002 | Shimizu et al. | 347/85 |
| 6,485,137 | B2 * | 11/2002 | Karlinski et al. | 347/92 |
| 6,733,114 | B2 * | 5/2004 | Kobayashi et al. | 347/85 |
| 7,101,028 | B2 * | 9/2006 | Takagi | 347/86 |
| 2001/0040613 | A1 | 11/2001 | Nakazawa et al. | |
| 2002/0047882 | A1 | 4/2002 | Karlinski et al. | |
| 2004/0252146 | A1 * | 12/2004 | Naka et al. | 347/6 |

FOREIGN PATENT DOCUMENTS

| | | | |
|---|---|---|---|
| EP | 1 203 666 | A1 | 5/2002 |
| JP | 2001-260390 | A | 9/2001 |

OTHER PUBLICATIONS

Extended European Search Report from EP 05015876.5-1251 (Oct. 11, 2007).

* cited by examiner

*Primary Examiner*—Anh T. N. Vo
(74) *Attorney, Agent, or Firm*—Stroock & Stroock & Lavan LLP

(57) ABSTRACT

The invention is directed to a liquid container and a method for detecting a remaining quantity of liquid that can precisely detect that the liquid is completely consumed. A bag shaped main pack 11 for storing liquid to be supplied to a liquid consuming device 5 and a bag shaped sensor pack 12 in which the liquid to be supplied to the liquid consuming device 5 from the main pack 11 is temporarily held halfway to detect the state of a remaining quantity of the liquid in the main pack 11 are provided. Thus, since the quantity of the liquid held in the sensor pack 12 changes in accordance with the remaining quantity of the liquid of the main pack 11, the changed state appears as a change of the form of the sensor pack 12, and accordingly, a displacement due to the change can be utilized to assuredly detect, for instance, that the liquid in the main pack 11 is completely consumed.

10 Claims, 10 Drawing Sheets

LIQUID CONTAINER AND METHOD FOR DETECTING REMAINING QUANTITY OF LIQUID

BACKGROUND OF THE INVENTION

The present invention relates to a liquid container and a method for detecting a remaining quantity of liquid that are applied to a liquid consuming device such as an ink jet type recording device or the like.

The ink jet type recording device as a representative example of the liquid consuming device supplies ink to an ink injection device as the liquid consuming device from an ink container that stores the ink as liquid. An unit is provided for informing a user of an ink end that the ink in the ink container is consumed and exhausted to reach the ink end.

In a detecting unit of a remaining quantity of ink disclosed in JP-A-2001-260390, a detecting plate is directly attached to an ink bag formed with a flexible sheet type material, and when the ink bag is contracted as the ink is consumed, a displacement is generated in the detecting plate to operate an ink end detector in accordance with the displacement.

However, in the type that the detecting plate is directly attached to the ink bag as described above, since the contraction change of an entire part of the ink bag is detected by the detecting plate, adequate detection accuracy cannot be obtained. Namely, since the ink bag shows a subtle displacement in an ink end area, a state that the remaining quantity of the ink is completely zero or a state near thereto as much as possible is undesirably hardly detected only by the operation of the detecting plate.

SUMMARY OF THE INVENTION

The present invention is proposed to solve the above-described problem and it is an object of the present invention to provide a liquid container and a method for detecting a remaining quantity of liquid that can precisely detect that liquid is completely consumed.

In order to achieve the above-described object, a liquid container of the present invention comprises, as a summary, a bag shaped main pack for storing liquid to be supplied to a liquid consuming device and a bag shaped sensor pack in which the liquid to be supplied to the liquid consuming device from the main pack is temporarily held halfway to detect the state of a remaining quantity of the liquid of the main pack.

Further, to achieve the above-described object, a method for detecting a remaining quantity of liquid of the present invention comprises, as a summary, steps of: preparing a bag shaped main pack for storing liquid to be supplied to a liquid consuming device and a bag shaped sensor pack in which the liquid to be supplied to the liquid consuming device from the main pack is temporarily held halfway to detect the state of a remaining quantity of the liquid of the main pack; pressurizing the main pack by gas introduced from a pressure generator to apply a delivery pressure to the liquid in the main pack; and detecting that the liquid in the main pack is completely consumed in accordance with a displacement in the direction in which the volume of the sensor pack is decreased.

In the liquid container, the bag shaped sensor pack performs a function for temporarily halfway holding the liquid to be supplied to the liquid consuming device from the main pack to detect the state of the remaining quantity of the liquid in the main pack. That is, since the liquid is temporarily held in the bag shaped sensor pack having a form independent of the main pack, the state of the remaining quantity of the liquid in the main pack can be conscientiously detected in the sensor pack. This means that since the quantity of the liquid held in the sensor pack changes in accordance with the remaining quantity of the liquid of the main pack, the changed state appears as a change of the form of the sensor pack, and accordingly, a displacement due to the change can be utilized to assuredly detect, for instance, that the liquid in the main pack is completely consumed.

In the liquid container of the present invention, when the main pack is accommodated in a hard case and a pressure introducing passage is provided for introducing gas to the hard case to pressurize the main pack so that a delivery pressure is applied to the liquid in the main pack, the main pack is pressurized by the gas so that the liquid assuredly enters the sensor pack and is temporarily held. Thus, liquid pressure acting on the sensor pack causes the form of the sensor pack to be apparently changed. Accordingly, the state of the remaining quantity of the liquid in the main pack can be accurately detected on the basis of this phenomenon.

In the liquid container according to the present invention, when an energizing unit operating so as to decrease the volume of the sensor pack is provided, if the liquid in the main pack is completely consumed, the liquid pressure from the main pack disappears. Thus, the sensor pack is necessarily displaced so as to decrease its volume by the energizing unit. Accordingly, this displacement is employed to detect the consumption of the liquid so that a detection of high reliability is realized. Further, after the liquid in the main pack is completely consumed, the liquid temporarily held in the sensor pack is supplied to the liquid consuming device by the energizing unit. Accordingly, the liquid remaining in the sensor pack can be removed or can be economically reduced to a small quantity that hardly has an actual effect.

In the liquid container according to the present invention, when a detecting unit is provided for detecting that the liquid in the main pack is completely consumed in accordance with the displacement in the direction in which the volume of the sensor pack is decreased, the detecting unit is operated in accordance with the displacement indicating that the liquid in the main pack is completely consumed. Accordingly, the complete consumption of the liquid in the main pack can be conscientiously detected. Further, since the displacement when the liquid temporarily held in the sensor pack is finally consumed is utilized, the liquid can be consumed without wastefulness and the above-described conscientious detection can be realized at the same time.

In the liquid container according to the present invention, when a material with which the sensor pack is formed is substantially the same as a flexible sheet type material forming the main pack, various kinds of conditions such as a flexibility or a gas barrier property necessary for storing the liquid in the main pack are also established in the sensor pack. Accordingly, a deformation required for the sensor pack or a storage property of the liquid temporarily held in the sensor pack is satisfactory.

In a method for detecting a remaining quantity of liquid according to the present invention, a main pack is pressurized by gas introduced from a pressure generator to apply a delivery pressure to the liquid in the main pack and to detect that the liquid in the main pack is completely consumed in accordance with a displacement in the direction in which the volume of a sensor pack is decreased. As described above, since the displacement in the direction in which the volume of the sensor pack is decreased is a phenomenon appearing after the liquid in the main pack is completely consumed, the exhaustion of the liquid in the main pack can be assuredly detected.

The present disclosure relates to the subject matter contained in Japanese patent application No. 2004-215332 (filed on Jul. 23, 2004), which is expressly incorporated herein by reference in its entirety.

BRIEF DESCRIPTION OF THE DRAWINGS

FIG. 6 is a block diagram showing a relation between an ink cartridge and a control part or the like.

DESCRIPTION OF THE PREFERRED EMBODIMENT

Now, a best mode for carrying out a liquid container and a method for detecting a remaining quantity of liquid according to the present invention will be described below.

The liquid container and the method for detecting the remaining quantity of liquid of the present invention can function for various kinds of liquids as objects as described above. In a below-described embodiment, an example applied to an ink jet type recording device is described as a representative example.

First Embodiment

FIGS. 1 to 10 show a first embodiment of the liquid container and the method for detecting the remaining quantity of liquid.

Figure 1:
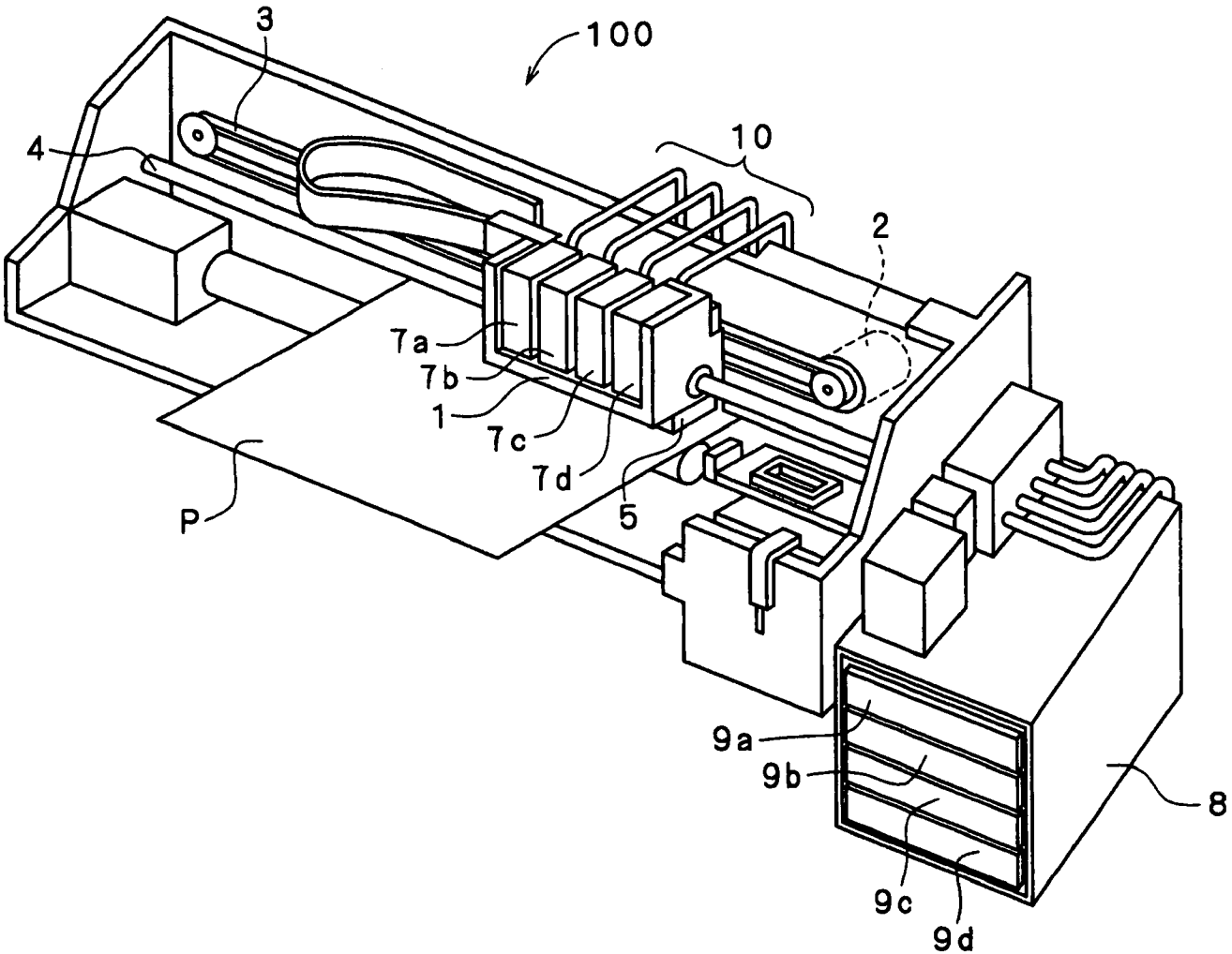
FIG. 1 is a perspective view showing an entire structure of an ink jet type recording device.

FIG. 1 is a perspective view showing entirely the ink jet type recording device 100 to which the present invention is applied. Here, a state in which a main body cover is removed is shown to clearly represent an inner structure. In FIG. 1, a carriage 1 reciprocates in a main scanning direction along a carriage guide shaft 4 through a timing belt 3 driven by a driving motor 2. In a side of the carriage 1 opposed to a recording medium P, a recording head 5 is provided.

To the carriage 1, sub-tanks 7*a* to 7*d* for supplying ink to the recording head 5 are attached. In the side part of the main body of the recording device 100, a cartridge holder 8 is provided and ink packs (not shown in FIG. 1) filled with inks such as black, yellow, magenta and cyan are respectively accommodated in ink cartridges 9*a* to 9*d*. The Ink cartridges 9*a* to 9*d* are respectively connected to the sub-tanks 7*a* to 7*d* by flexible supply tubes 10 so that the ink can be supplied. In the cartridge holder 8 side, ink supply pins 8*a* connected to the ends of the supply tubes 10 are provided and inserted into a below-described joint pipe 18.

Figure 2:
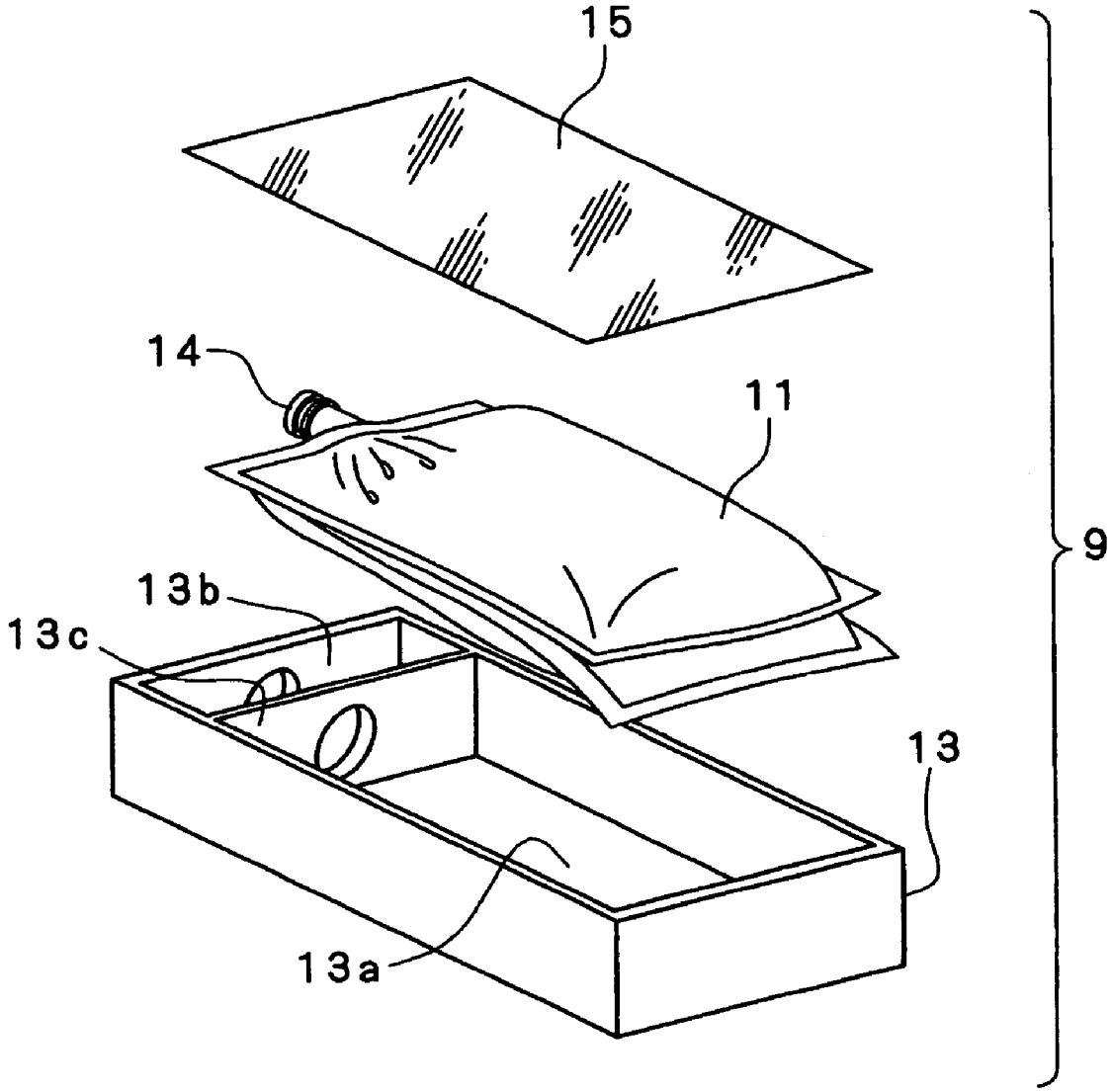
FIG. 2 is a perspective view showing a disassembled cartridge.
Figure 3:
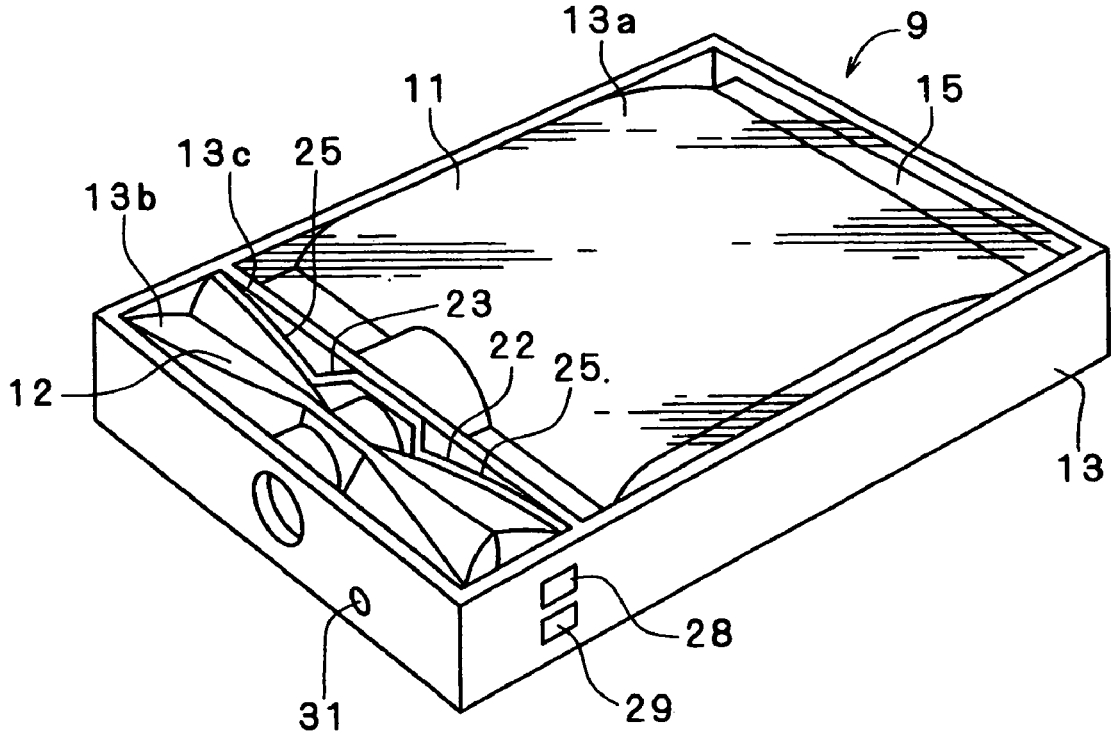
FIG. 3 is a perspective view showing an assembled cartridge.

The ink cartridge 9 includes, as shown in FIGS. 2 and 3, a hard case 13 sealed by a film 15 functioning as a cover member and a main pack 11 having an ink supply port 14 and filled with the ink. In the hard case 13, a main accommodating part 13*a* in which the main pack 11 is accommodated and a sub-accommodating part 13*b* in which a below-described sensor pack 12 is accommodated are provided and a partition plate 13*c* is provided between the main accommodating part 13*a* and the sub-accommodating part 13*b*.

The main pack 11 is formed with a flexible sheet type material. To improve a gas barrier property, the main pack is formed with an aluminum laminate film having an aluminum foil sandwiched in between two films, for instance, a nylon film in an outer side and a polyethylene film in an inner side. Further, in this embodiment, the film 15 seals the main accommodating part 13*a*. As the main pack 11, a gazette type that can ensure a large quantity of accommodation of ink is used as shown in FIG. 2 and FIGS. 7 to 10.

Figure 4:
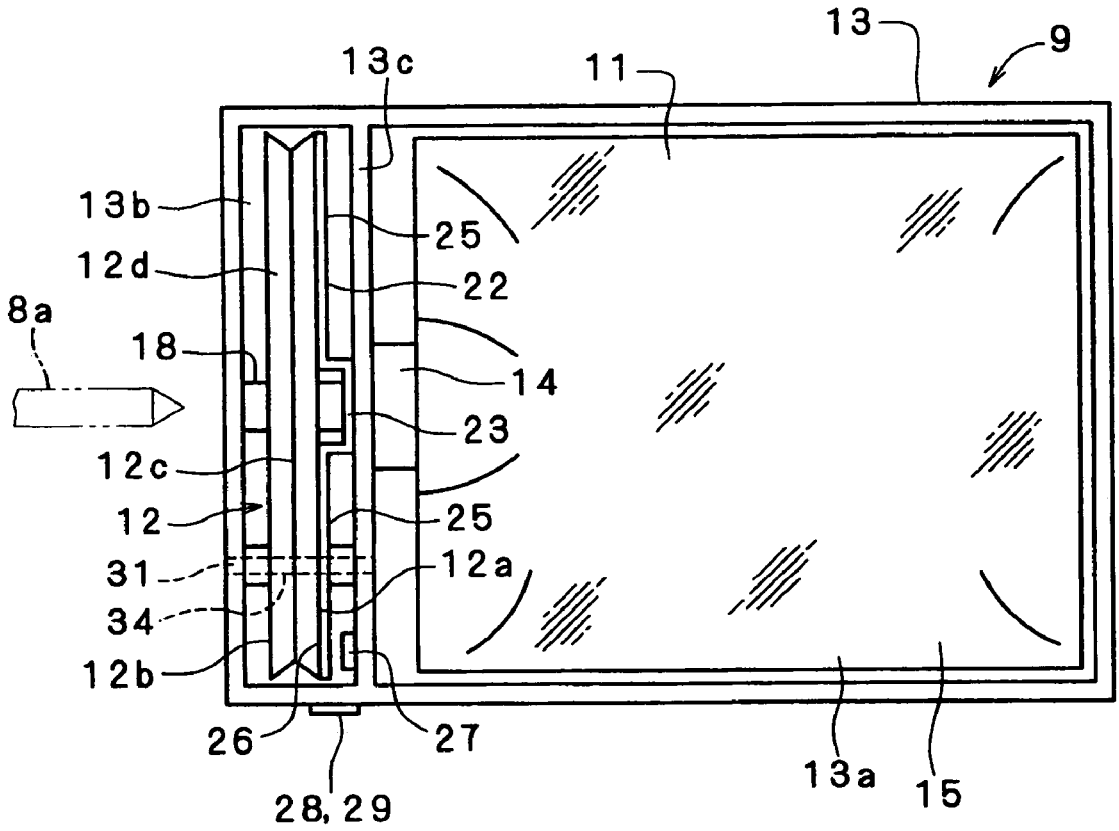
FIG. 4 is a plan view showing the assembled cartridge.
Figure 5:
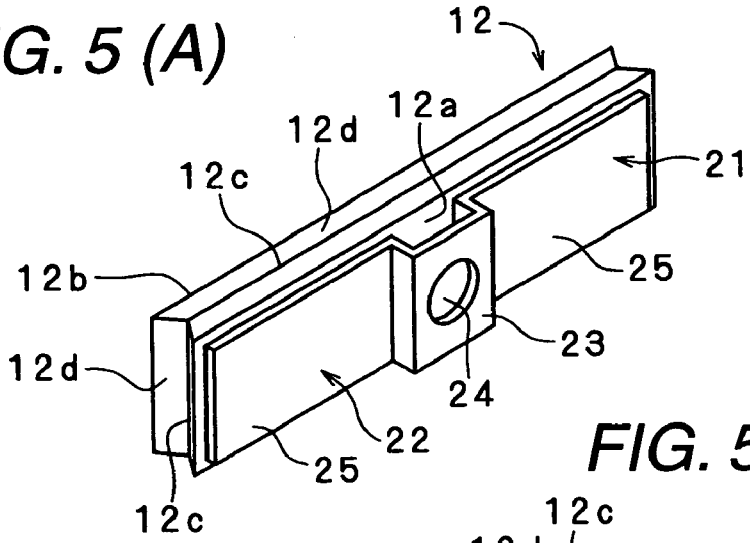
FIG. 5 is a perspective view of a sensor pack and a sectional view of main parts.
Figure 5:
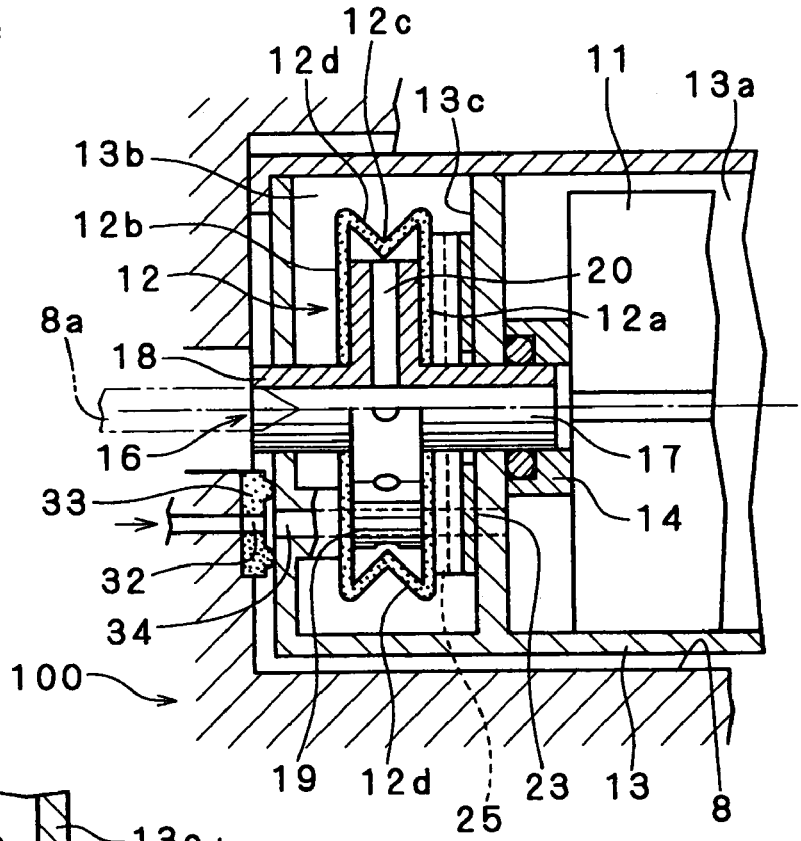
Figure 5:
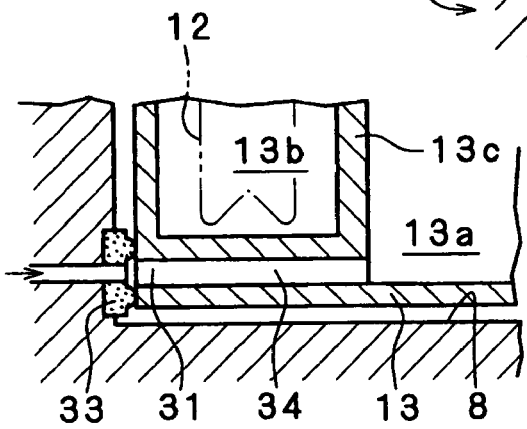

Now, referring to FIGS. 4 and 5, the sensor pack 12 will be described below.

In the sensor pack 12, the ink supplied to the recording head 5 from the main pack 11 is temporarily held halfway to detect the state of a remaining quantity of the ink in the main pack 11. The sub-accommodating part 13*b* in which the sensor pack 12 is accommodated is an elongated space extending upward and downward in FIG. 4. The sensor pack 12 is formed with the same sheet material as that of the main pack 11 as described above. As shown in FIG. 5, flat end members 12*a* and 12*b* are opposed in a parallel state and the both the end members 12*a* and 12*b* are connected together by a connecting member 12*d* having a bent part 12*c* as an inward folding line part. The sensor pack 12 has a structure that the end members 12*a* and 12*b* are connected together by the connecting member 12*d* while the liquid-tightness of the end members 12*a* and 12*b* is maintained.

Since the sensor pack 12 serves to temporarily hold halfway the ink supplied to the recording head 5 from the main pack 11, one part of the sensor pack is connected to the main pack 11 through a joint pipe 17 and the other part of the sensor pack is connected to the supply tube 10 through the joint pipe 18 and the ink supply pin 8*a*. As such a connecting structure, various kinds of structures may be used. Here, a joint member 16 having a pipe member combined with a flange is exemplified. The joint pipes 17 and 18 are arranged in a coaxial direction and a disk shaped distributing flange 19 is integrally provided between both the joint pipes 17 and 18.

The one joint pipe 17 is fitted to a pipe structural part forming the ink supply port 14 of the main pack 11 and the other joint pipe 18 is connected to the supply tube 10 through the ink supply pin 8*a*. In the distributing flange 19, a communicating hole 20 is opened so that the ink from the main pack 11 can enter the sensor pack 12.

Atmospheric pressure is allowed to act on the main pack 11 to generate delivery pressure in the ink of the main pack 11. As shown in a block diagram of FIG. 6, in this embodiment, a pressurizing pump 30 as a pressure generator for pressurizing air is attached to the ink jet type recording device 100 so that compressed air from the pressurizing pump 30 is introduced to the hard case 13 through an inlet port 31. As shown in FIG. 5(B), in an interior part of the cartridge holder 8, a supply port 32 for the compressed air is opened. The relative positions of the supply port 32 and the inlet port 31 are set so that when the hard case 13 is pressed into the cartridge holder 8, the supply port 32 communicates with the inlet port 31. To maintain the air-tightness of a connecting part of the supply port 32 and the inlet port 31, an air-tight packing 33 is attached to the interior part of the cartridge holder 8.

Pressurized air introduced from the inlet port 31 is supplied to the main accommodating part 13*a* via a passage 34 that does not communicate with the sub-accommodating part 13*b* and transmitted only to the main pack 11.

The sensor pack 12 is combined with an energizing unit 21 operating so as to decrease an inner volume thereof For the energizing unit 21, an energizing force can be obtained by a leaf spring, a compression coil spring, an elastic rubber and a fluid pressure or the like. In a type of the first embodiment, the leaf spring is used. The leaf spring 22 is formed by bending an elongated and flat spring steel to substantially have a hat shape in section. In a base part 23 at a center part, a through hole 24 through which the joint pipe 17 passes is opened. Then, in both the sides of the base part 23, bending pieces 25 are formed that come into tight contact with the end member 12*a* of the sensor pack 12.

A detecting unit is provided for detecting that the ink in the main pack 11 is completely consumed in accordance with a displacement in the direction in which the volume of the sensor pack 12 is decreased. The detecting unit electrically detects a consumption of the ink. Various kinds of detecting units such as a contact type or a non-contact type may be employed. The first embodiment uses a type that a signal obtained by the on/off operation of a contact in the hard case 13 is inputted to a control part via an external contact formed on an outer side surface of the hard case 13.

Figure 6:
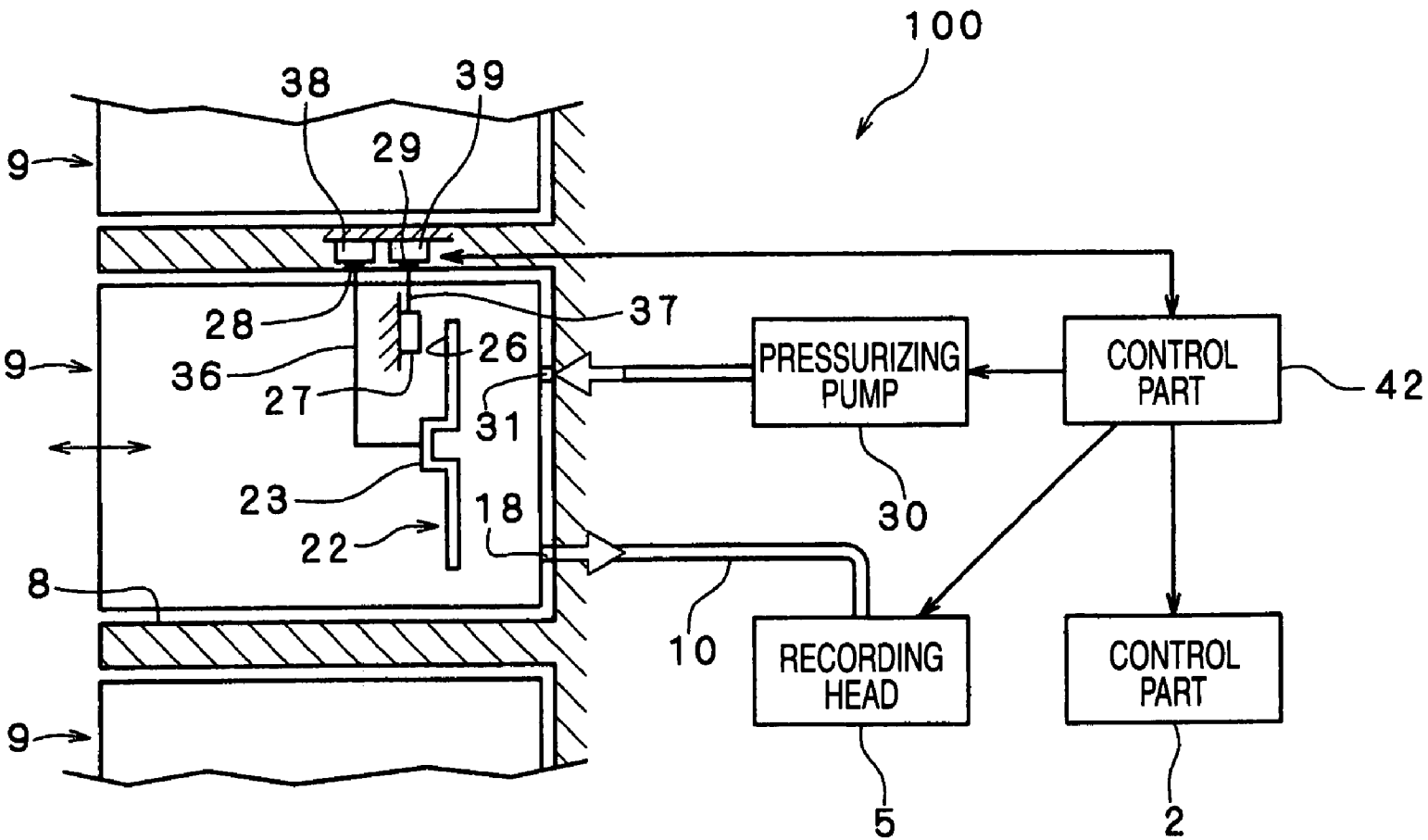
Figure 7:
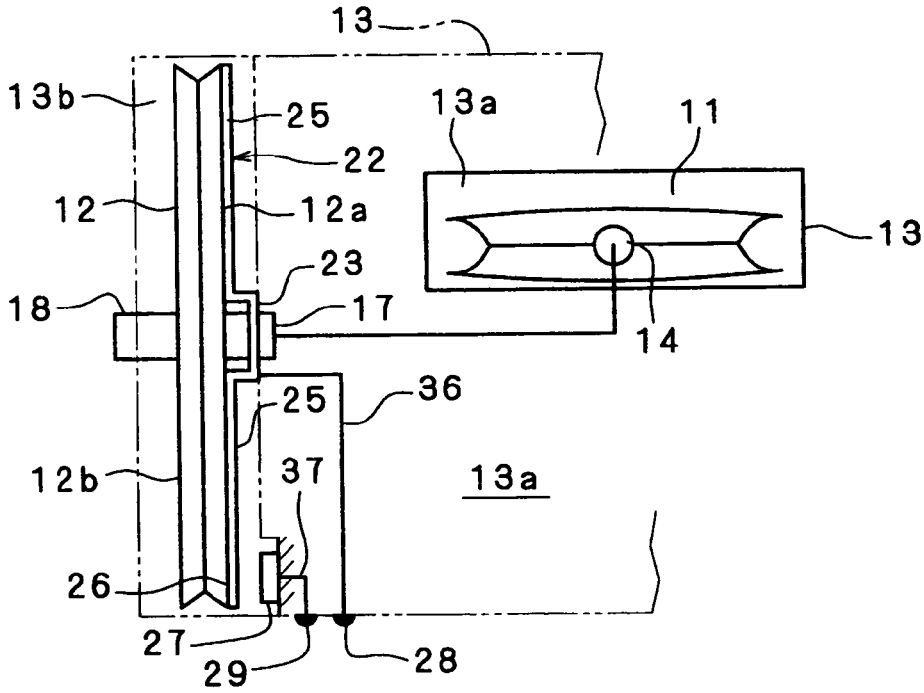
FIG. 7 is a diagram showing an operating state.

As simply shown in FIGS. 6 and 7, an end part of the bending piece 25 of the leaf spring 22 is a movable contact 26 and a fixed contact 27 is provided at a position opposed to the movable contact 26. The fixed contact 27 is attached to the partition plate 13*c*. Both the contacts 26 and 27 are respectively connected to external contacts 28 and 29 disposed on the outer side surface of the hard case 13 through a conductor 36 connected to the base part 23 and a conductor 37 connected to the fixed contact 27. On an inner surface of the cartridge holder 8, static contacts 38 and 39 are provided that come into contact with the external contacts 28 and 29 to supply a signal showing the state of a remaining quantity of the ink in the main pack 11 to a control part 42. Here, the leaf spring 22 is employed as the movable contact. However, two fixed contacts may be provided that are electrically conducted by allowing the leaf spring to come into contact therewith or a method using a micro-switch may be employed.

As the ink is consumed as described below, the on/off operation of the movable contact and the fixed contact 27 is carried out. An output signal therefrom is transmitted to the control part 42 of the ink jet type recording device 100 to detect the consumed state of the ink. The control part 42 controls the entire operation of the ink jet type recording device 100 including the pressurizing pump 30, the recording head 5 and the driving mechanism 2 for reciprocating the carriage.

Now, referring to FIGS. 7 to 10, the operating states of the respective parts with the consumption of the ink will be described below. The size of the main pack 11 in these figures is illustrated in a greatly reduced size on account of a limited space.

FIG. 7 shows a state that the main accommodating part 13*a* remains in atmospheric pressure and the ink jet type recording device 100 does not perform a printing operation. Accordingly, the volume of the sensor pack 12 is pressed by the leaf spring 22 to be minimum. Under this state, the movable contact 26 remains separated from the fixed contact 27. As shown in FIGS. 4 and 5, a free state of the leaf spring 22 is similarly illustrated and the volume of the sensor pack 12 is minimum in accordance with the resiliency from the bending piece 25.

Figure 8:
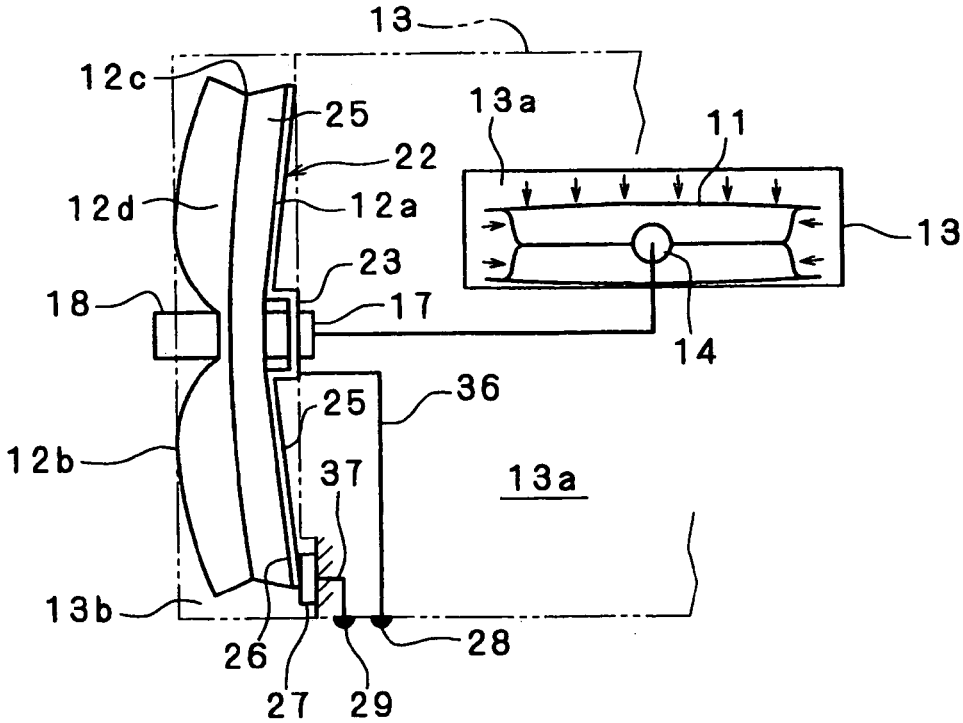
FIG. 8 is a diagram showing an operating state.

FIG. 8 shows a state that the pressurized air is introduced to the main accommodating part 13*a* so that the main pack 11 is pressurized and the delivery pressure is generated in the ink therein. Since the pressure of the ink temporarily held in the sensor pack 12 is raised by the delivery pressure of the ink, the bent part 12*c* in the sensor pack 12 is extended and one end member 12*a* bends the bending pieces 25. The other end member 12*b* swells to abut on the inner surface of the sub-accommodating part 13*b*. Under this state, since the movable contact 26 comes into contact with the fixed contact 27, electric current is supplied. A signal outputted by supplying the electric current is recognized in the control part 42 to indicate that the ink in the main pack is adequately stored.

Figure 9:
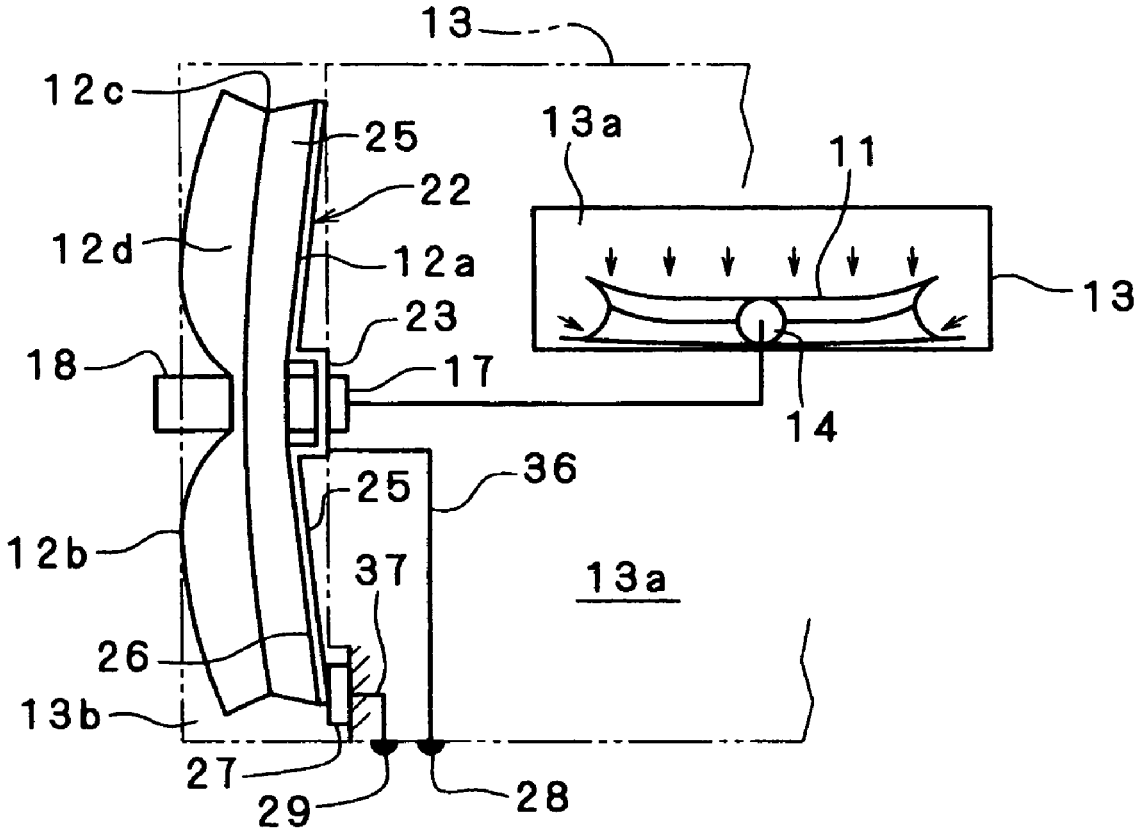
FIG. 9 is a diagram showing an operating state.

FIG. 9 shows a state that the ink in the main pack 11 is completely consumed, that is, the ink is consumed to a part near to, what is called, an ink end. Even under this state, air pressure acts on the main pack 11 to apply the delivery pressure to a small quantity of ink. Accordingly, the sensor pack 12 is in the same state as that shown in FIG. 8. While the movable contact 26 remains coming into contact with the fixed contact 27, a signal having a meaning that the ink is present in the main pack 11 is supplied to the control part 42.

Figure 10:
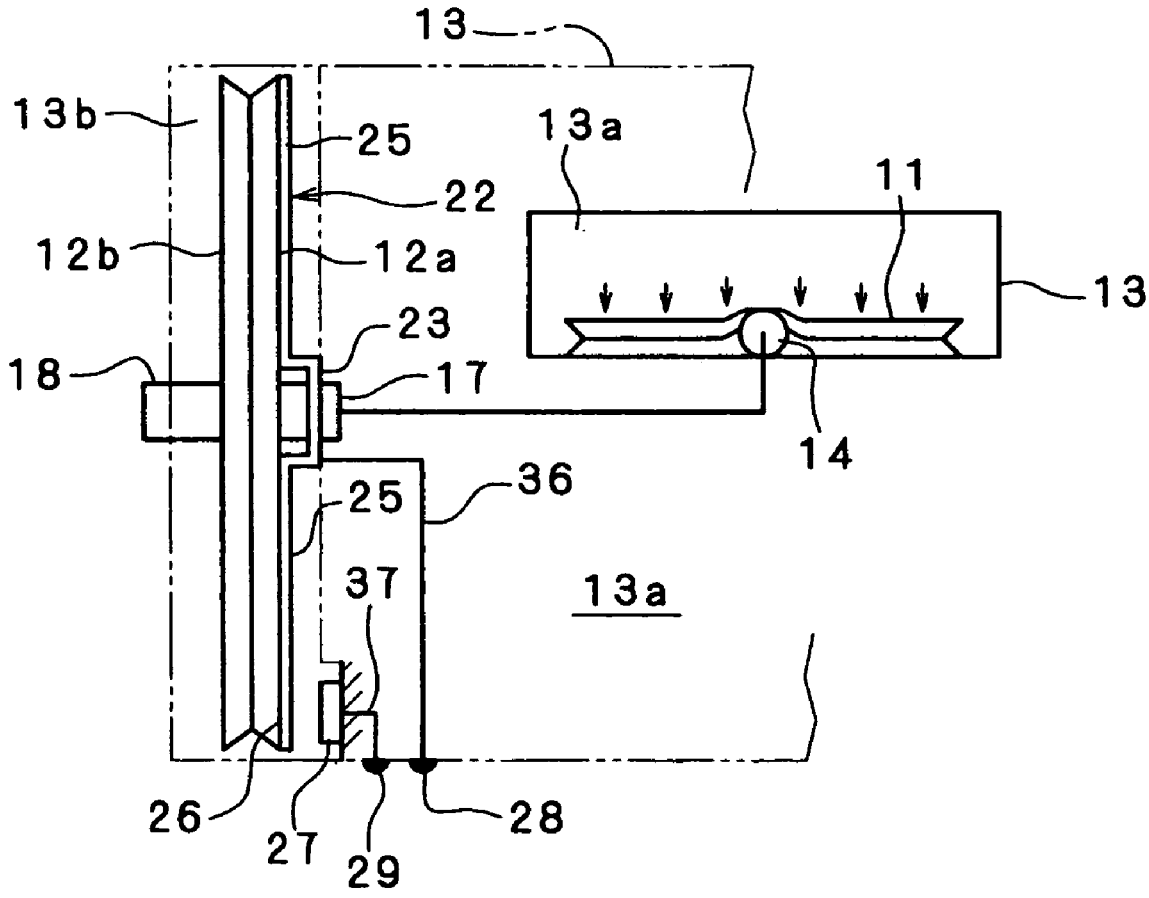
FIG. 10 is a diagram showing an operating state.

FIG. 10 shows a state that while the main pack 11 is pressurized by the air pressure, the ink in the sensor 12 is consumed. That is, since the main pack 11 is pressurized, the ink temporarily held in the sensor pack 12 does not flow back to the main pack 11 and is consumed as the ink of the recording head 5 side is discharged. Since the volume of the sensor pack 12 is decreased due to the consumption of the ink in the sensor pack 12, the bending pieces 25 move so that the movable contact 26 is separated from the fixed contact 27 to stop the supply of the electric current. Since the contacts 26 and 27 are turned off so that the signal to the control part 42 is stopped, the control part 42 detects the stop of the signal to detect that the ink is completely consumed (ink end). This detecting signal is supplied to a display part of the ink jet type recording device 100 that is not shown in the drawings to display the ink end.

Operational effects of the first embodiment are enumerated as described below.

The bag shaped sensor pack 12 performs a function for temporarily halfway holding the ink supplied to the recording head 5 of the ink jet type recording device 10 from the main pack 11 to detect the state of the remaining quantity of the ink in the main pack 11. That is, since the ink is temporarily held in the bag shaped sensor pack 12 having a form independent of the main pack 11, the state of the remaining quantity of the ink in the main pack 11 can be conscientiously detected in the sensor pack 12. This means that since the quantity of the ink held in the sensor pack 12 changes in accordance with the remaining quantity of the ink of the main pack 11, the changed state appears as a change of the form of the sensor pack 12, and accordingly, a displacement due to the change can be utilized to assuredly detect the ink end in the main pack 11.

The main pack 11 is accommodated in the hard case 13 and the pressure introducing passage 31 is provided for introducing gas to the hard case 13 to pressurize the main pack 11 so that a delivery pressure is applied to the ink in the main pack 11. Thus, the main pack 11 is pressurized by the gas so that the ink assuredly enters the sensor pack 12 and is temporarily held. Then, ink pressure acting on the sensor pack 12 causes the form of the sensor pack 12 to be apparently changed. Accordingly, the state of the remaining quantity of the ink in the main pack 11 can be accurately detected on the basis of this phenomenon.

Since the energizing unit operating so as to decrease the volume of the sensor pack 12, that is, the leaf spring 22 is provided, when the ink in the main pack 11 is completely consumed, the ink pressure from the main pack 11 disappears. Thus, the sensor pack 12 is necessarily displaced so as to decrease its volume by the leaf spring 22. Accordingly, this displacement is employed to detect the consumption of the ink so that a detection of high reliability is realized. Further, after the ink in the main pack 11 is completely consumed, the ink temporarily held in the sensor pack 12 is supplied to the recording head 5 by the leaf spring 22. Accordingly, the ink remaining in the sensor pack 12 can be removed or can be economically reduced to a small quantity that hardly has an actual effect.

A detecting unit is provided for detecting that the ink in the main pack 11 is completely consumed in accordance with the displacement in the direction in which the volume of the sensor pack 12 is decreased. That is, since the movable contact 26 and the fixed contact 27 are provided, the detecting unit is operated in accordance with the displacement indicating that the ink in the main pack 11 is completely consumed. Accordingly, the complete consumption of the ink in the main pack 11 can be conscientiously detected. Further, since the displacement when the ink temporarily held in the sensor pack 12 is finally consumed is utilized, the ink can be consumed without wastefulness and the above-described conscientious detection can be realized at the same time.

Since the material with which the sensor pack 12 is formed is substantially the same as the flexible sheet type material forming the main pack 11, various kinds of conditions such as the flexibility or the gas barrier property necessary for storing the ink in the main pack 11 are also established in the sensor pack 12. Accordingly, a deformation required for the sensor pack 12 or a storage property of the ink temporarily held in the sensor pack 12 is improved.

In the method for detecting the remaining quantity of liquid according to the present invention, the main pack 11 is pressurized by air introduced from the pressurizing pump 30 as a pressure generator to apply a delivery pressure to the ink in the main pack 11 and to detect that the ink in the main pack 11 is completely consumed in accordance with the displacement in the direction in which the volume of the sensor pack 12 is decreased. As described above, since the displacement in the direction in which the volume of the sensor pack 12 is decreased is a phenomenon appearing after the ink in the main pack 11 is completely consumed, the exhaustion of the ink in the main pack 11 can be assuredly detected.

Second Embodiment

Figure 11:
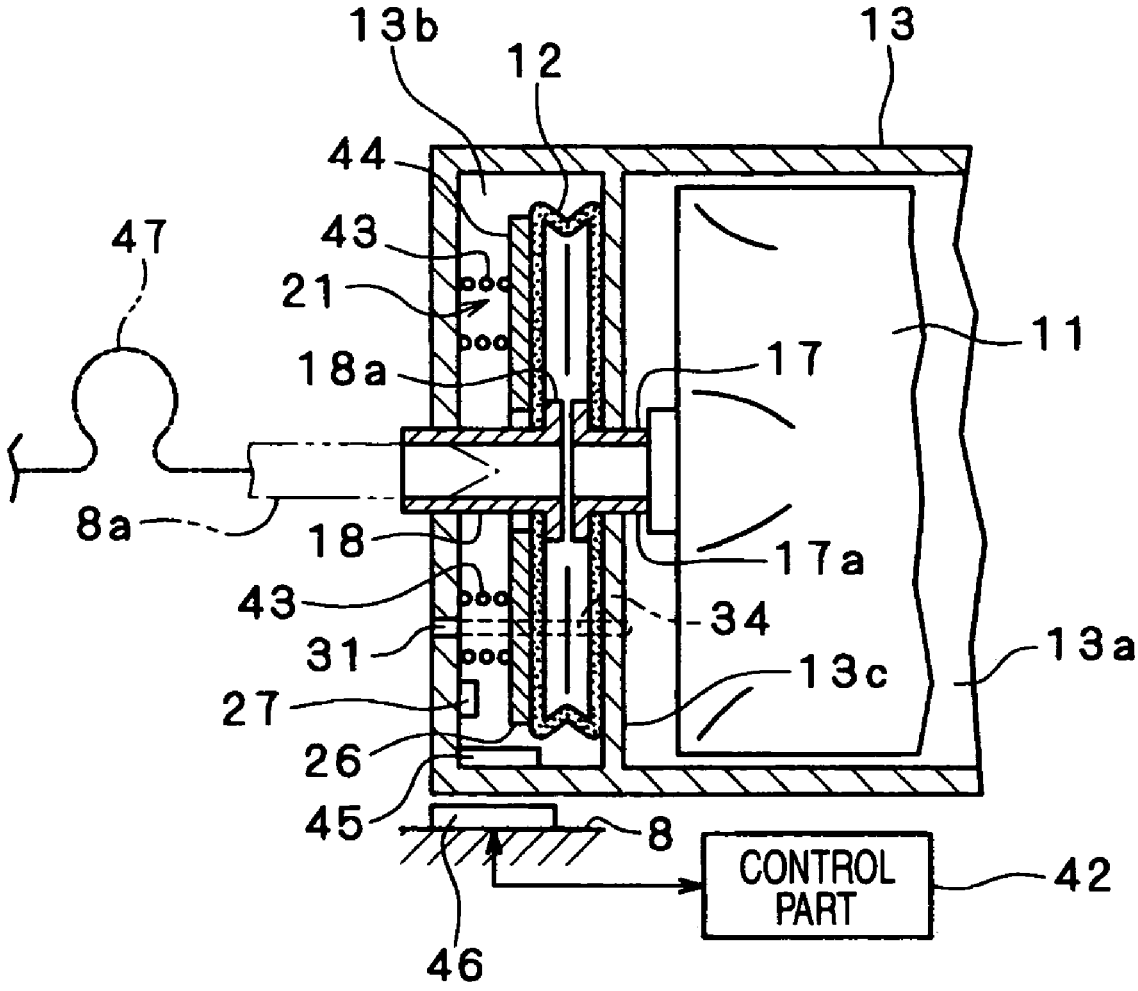
FIG. 11 is a sectional view of a second embodiment.

FIG. 11 shows a second embodiment of a liquid container and a method for detecting a remaining quantity of liquid according to the present invention.

In this embodiment, flanges 17*a* and 18*a* are respectively provided in joint pipes 17 and 18. The flanges 17*a* and 18*a* are connected to a sensor pack 12. As an energizing unit, a compression coil spring 43 is employed. A resilient force of the compression coil spring acts on the sensor pack 12 through a pressing plate 44. Further, an inner antenna 45 is provided for transmitting the on/off operation of a movable contact 26 and a fixed contact 27 as a signal. On the other hand, an external antenna 46 is attached to a cartridge holder 8. A signal received by the external antenna 46 is inputted to a control part 42. Further since the joint pipe 18 is expansible, an absorbing part 47 for absorbing an expansible displacement is provided in a supply tube 10. Other components than the above-described members are the same as those of the above-described embodiment. The same parts are designated by the same reference numerals and realize the same operational effects as those of the above-described embodiment.

The above-described embodiments are respectively applied to the ink jet type recording device. However, the liquid container and the method for detecting the remaining quantity of liquid that are obtained by the present invention are not employed only for the ink of the ink jet type recording device, but also may be employed for injecting glue, manicure, electrically conductive liquid (liquid metal) etc. Further, in the above-described embodiments, the ink jet type recording device using the ink as one of liquids is explained. However, the present invention may be applied to all liquid injection heads for jetting liquid such as a recording head used in an image recording device such as a printer, a coloring material injection head used for producing a color filter such as a liquid crystal display, an electrode material injection head used for forming an electrode such as an organic EL display, an FED (face light emitting display) or the like, a bio-organic injection head used for producing bio-chips.

What is claimed is:

1. A liquid container comprising:

a bag shaped main pack for storing liquid to be supplied to a liquid consuming device;

a bag shaped sensor pack in which the liquid is temporarily held, including;

flat end members which are opposed in a parallel state, and a connecting member connecting the flat end members and having an inwardly folded part; and a detecting unit for detecting that the liquid in the main pack is completely consumed in accordance with a displacement in the direction in which the volume of the sensor pack is decreased, wherein a material with which the sensor pack is formed is substantially the same as a flexible sheet type material forming the main pack.

2. A liquid container according to claim 1, wherein the main pack is accommodated in a hard case and a pressure introducing passage is provided for introducing gas to the hard case to pressurize the main pack so that a delivery pressure is applied to the liquid in the main pack.

3. A liquid container according to claim 1, further comprising an energizing unit operating so as to decrease the volume of the sensor pack.

4. A method for detecting a remaining quantity of liquid comprising steps of:

preparing a case having both a bag shaped main pack for storing liquid to be supplied to a liquid consuming device and a bag shaped sensor pack in which the liquid is temporarily held, the sensor pack including;

flat end members which are opposed in a parallel state, and a connecting member connecting the flat end members and having an inwardly folded part;

pressurizing the main pack by gas introduced from a pressure generator to apply a delivery pressure to the liquid in the main pack; and detecting that the liquid in the main pack is completely consumed in accordance with a displacement in the direction in which the volume of the sensor pack is decreased, wherein a material with which the sensor pack is formed is substantially the same as a flexible sheet type material forming the main pack.

5. A liquid container storing liquid to be supplied to a liquid consuming apparatus, the liquid container comprising:

a hard case having a main accommodating part, a sub-accommodating part and a pressure-fluid passage that is in fluid communication with the main accommodating part and is isolate from the sub-accommodating part;

an integral main pack including a flexible bag part formed by flexible film material, and an ink supply port connected to the flexible bag part, wherein the integral main pack is insertable and accommodated, as a unit, in the main accommodating part;

an integral sensor pack including a flexible bag part formed by flexible film material, and a joint member connected to the flexible bag part of the sensor pack, wherein the joint member has a first end and a second end, both protruding from the flexible bag part of the sensor pack, and a communicating hole opened to an interior of the flexible bag part of the sensor pack, and the integral sensor pack is insertable and accommodated, as a unit, in the sub-accommodating part, the sensor pack including;

flat end members which are opposed in a parallel state, and a connecting member connecting the flat end members and having an inwardly folded part, wherein:

when the main pack and sensor pack are respectively accommodated in the main accommodating part and the sub-accommodating part, the first end of the joint member is accessible from an exterior of the hard case, and the ink supply port is connected to the second end of the joint member so that an interior of the flexible bag part of the main pack is in fluid communication via the communicating hole of the joint member with the interior of the flexible bag part of the sensor pack, and a material with which the sensor pack is formed is substantially the same as a flexible sheet type material forming the main pack.

6. A liquid container according to claim 5, further comprising:

an energizing unit that provides an energizing force to the flexible bag part of the sensor pack in such a direction that the interior of the flexible bag part of the sensor pack contracts.

7. A liquid container according to claim 6, wherein when a pressure is applied via the pressure-fluid passage to the flexible bag part of the main pack in a state in which a predetermined amount or more of liquid remains in the main pack, the interior of the flexible bag part of the sensor pack expands to a predetermined level against the energizing force of the energizing unit by flow of liquid from the main pack to the sensor pack.

8. A liquid container according to claim 7, further comprising:

a sensor which provides an output indicative of a state in which the interior of the flexible bag part of the sensor pack does not expand to the predetermined level even when the pressure is applied to the flexible bag part of the main pack.

9. A liquid container according to claim 7, further comprising:

a sensor which provides an output indicative of a state in which the interior of the flexible bag part of the sensor pack contracts from the predetermined level even when the pressure is continuously applied to the flexible bag part of the main pack.

10. A liquid container according to claim 8 or 9, wherein the sensor includes a movable contact movable along with the flexible bag part of the sensor pack, and a fixed contact disposed on an interior wall of the sub-accommodating part.

* * * * *